US012116703B2

(12) United States Patent
Han et al.

(10) Patent No.: US 12,116,703 B2
(45) Date of Patent: Oct. 15, 2024

(54) METHOD OF PREPARING PAN-BASED CARBON FIBERS

(71) Applicants: Tiangong University, Tianjin (CN); Hi-Tech Fiber Group Corporation, Beijing (CN)

(72) Inventors: Na Han, Tianjin (CN); Chao Wu, Tianjin (CN); Xingxiang Zhang, Tianjin (CN); Lejun Wang, Tianjin (CN); Jianyong Chen, Tianjin (CN); Zhiheng Sun, Tianjin (CN); Xujian Yang, Tianjin (CN); Jun Cai, Tianjin (CN)

(73) Assignees: Tiangong University, Tianjin (CN); HI- TECH FIBER GROUP CORPORATION, Beijing (CN)

( * ) Notice: Subject to any disclaimer, the term of this patent is extended or adjusted under 35 U.S.C. 154(b) by 0 days.

(21) Appl. No.: 17/286,463

(22) PCT Filed: Mar. 5, 2021

(86) PCT No.: PCT/CN2021/079360
§ 371 (c)(1),
(2) Date: Apr. 17, 2021

(87) PCT Pub. No.: WO2022/165903
PCT Pub. Date: Aug. 11, 2022

(65) Prior Publication Data

US 2024/0125008 A1 Apr. 18, 2024

(30) Foreign Application Priority Data

Feb. 5, 2021 (CN) ..... 202110159952.8

(51) Int. Cl.
*D01F 9/22* (2006.01)
*D01D 5/084* (2006.01)
(Continued)

(52) U.S. Cl.
CPC ..... *D01F 9/22* (2013.01); *D01D 5/084* (2013.01); *D01D 10/00* (2013.01); *D01F 1/02* (2013.01); *D01F 6/38* (2013.01); *D10B 2321/10* (2013.01)

(58) Field of Classification Search
CPC ..... D01F 9/22; D01F 1/02; D01F 6/38; D01F 9/00; D01F 9/08; D01F 9/12; D01F 9/14;
(Continued)

(56) References Cited

U.S. PATENT DOCUMENTS 6,083,856 A * 7/2000 Joseph ..... D04H 1/435 442/361

FOREIGN PATENT DOCUMENTS

CN 101586265 A 11/2009
CN 109401163 A 3/2019

OTHER PUBLICATIONS

Mukandan, et al., A photocrosslinkable melt processable acrylonitrile terpolymer as carbon fiber precursor, Polymer 2006; 47: 4163-4171 (Year: 2006).*

(Continued)

*Primary Examiner* — Daniel C. McCracken

(57) ABSTRACT

A method of preparing PAN-based carbon fibers relates to the technical field of materials. The method includes: S1. acrylonitrile, a second monomer and an unsaturated UV-sensitive cross-linking agent are mixed, an initiator is then added and a reaction is performed to obtain a meltable PAN-based copolymer; S2. the meltable PAN-based copolymer and a flow modifier are mixed to obtain a mixture, the mixture is extruded and pelletized, and then melt spinning is performed to obtain nascent fibers, the nascent fibers are stretched and annealed to obtain a PAN-based carbon fiber precursor; S3. ultraviolet irradiation is performed on the PAN-based carbon fiber precursor; S4. the PAN-based car-
(Continued)

bon fiber precursor after ultraviolet irradiation is pre-oxidized and carbonized to obtain PAN-based carbon fibers.

9 Claims, 1 Drawing Sheet

(51) Int. Cl.
*D01D 10/00* (2006.01)
*D01F 1/02* (2006.01)
*D01F 6/38* (2006.01)

(58) Field of Classification Search
CPC . D01F 9/32; D01F 9/324; D01F 9/326; D01F 9/328; D01F 11/00; D01F 11/02; D01F 11/04; D01F 11/06; D01F 11/08; D01F 11/10; D01F 11/12; D01F 11/121; D01F 11/122; D01F 11/123; D01F 11/124; D01F 11/125; D01F 11/126; D01F 11/127; D01F 11/128; D01F 11/129; D01F 11/14; D01F 11/16; D01D 5/084; D01D 10/00; D10B 2321/10
See application file for complete search history.

(56) References Cited

OTHER PUBLICATIONS

Fabrication of low-cost carbon fibers using economical precursors and advanced processing technologies, Oct. 7, 2018, Dalsu Choi, Hyun-Sig Kil, Sungho Lee.

* cited by examiner

METHOD OF PREPARING PAN-BASED CARBON FIBERS

CROSS REFERENCE TO RELATED APPLICATION

This application is a U.S. National Stage Entry of PCT Application with No. PCT/CN2021/079360, filed on Mar. 5, 2021.

TECHNICAL FIELD

The disclosure relates to the technical field of materials, and more specifically to a method of preparing PAN-based carbon fibers.

BACKGROUND

Carbon fiber (CF) is a kind of high-performance fiber composed of carbon elements, which has the characteristics of high temperature resistance, anti-friction, anti-radiation, electrical conductivity, shock absorption, noise reduction, corrosion resistance and the like. The tensile strength of carbon fiber is generally 3.0-7.0 GPa, the tensile modulus is 200-600 GPa, and the bulk density is 1.7-2.0 g/cm$^3$, which has extremely high specific strength and specific modulus. Due to the above-mentioned excellent characteristics, carbon fiber has become the top choice for advanced composite materials.

At present, there are many precursors used to prepare carbon fibers, such as pitch, polyacrylonitrile (PAN), polyethylene, xylogen, etc., but the precursors of commercial carbon fibers only have two categories: PAN-based and pitch-based. Among them, pitch-based carbon fiber has abundant raw material sources, low cost, and high carbon yield, but its low strength and poor product repeatability have greatly restricted its application. While PAN-based carbon fiber has a better comprehensive performance and simple process, its output accounts for more than 90% of global carbon fibers output. The preparation process of PAN-based carbon fiber mainly includes the preparation of PAN-based carbon fiber precursor, pre-oxidation and carbonization thereof, etc. Among them, the preparation cost of PAN-based carbon fiber precursor is relatively high, accounting for 44% of the entire process cost of carbon fiber.

In the prior art, the preparation method of the PAN-based carbon fiber precursor includes a wet spinning method and a melt spinning method. Wet spinning is mainly used in industrial production. This method can obtain carbon fibers with better structure, but requires the use of a large amount of polar and highly corrosive solvents, and also requires solvent recovery, therefor there exists problems of high cost and high pollution. As a contract, melt spinning has the advantage of low process cost (Choi, D.; Kil, H.-S.; Lee, S., Fabrication Of Low-Cost Carbon Fibers Using Economical Precursors And Advanced Processing Technologies, Carbon 2019, 142, 610-649). The inventors realized that although the melt spinning process is low cost, but there are many defects in the carbon fibers prepared by the precursor obtained by this method, and the carbon fibers obtained by this method cannot meet the requirements of industrial applications.

Researchers continue to explore the method of melt spinning. For example, ionic liquid is used to plasticize PAN-based polymer (CN101586265A); comonomers is used for plasticization (CN109401163B). In another example, researchers tried to use a flow modifier with good compatibility with the matrix as an external plasticizer to improve the melt flowability of the matrix at processing temperature.

SUMMARY

A method of preparing PAN-based carbon fiber provided by the present disclosure adopts an environmentally-friendly and efficient melt spinning process. The obtained PAN-based carbon fiber has good strength, simple process, environmental friendliness, and low price, which can significantly reduce process cost of PAN-based carbon fiber.

The present disclosure provides a method of preparing PAN-based carbon fibers, in at least one embodiment, the method includes the following steps:

S1. an acrylonitrile, a second monomer and an unsaturated UV-sensitive cross-linking agent are mixed, an initiator is then added and a reaction is performed to obtain a meltable PAN-based copolymer;

S2. the meltable PAN-based copolymer and a flow modifier are mixed to obtain a mixture, the mixture is extruded and pelletized, and then melt spinning is performed to obtain nascent fibers, the nascent fibers are stretched and annealed to obtain a PAN-based carbon fiber precursor;

S3. ultraviolet irradiation is performed on the PAN-based carbon fiber precursor;

S4. the PAN-based carbon fiber precursor after ultraviolet irradiation is pre-oxidized and carbonized to obtain PAN-based carbon fibers.

In further embodiments, in the step S1, the second monomer includes at least one of methyl acrylate, methyl methacrylate, itaconic acid, and vinyl imidazole.

In further embodiments, in the step S1, the unsaturated UV-sensitive cross-linking agent includes at least one of 4-acryloxybenzophenone (ABP), 2-hydroxy-4-acryloxybenzophenone (AHBP), 2-hydroxy-4-methoxybenzophenone (OBZ), 4-benzoylphenyl methacrylate (BPM), and octadecanophenone (OCP).

In further embodiments, in the step S1, the initiator includes at least one of ammonium persulfate and azobisisobutyronitrile.

In further embodiments, in the step S1, the mole percentage of the acrylonitrile, the second monomer, and the unsaturated UV-sensitive cross-linking agent is 85-95:5-15:0-5.

In further embodiments, in the step S1, the mole percentage of the initiator to the polymerized monomer is 0.05-0.1%, wherein, the polymerized monomer is the sum of the acrylonitrile, the second monomer and the unsaturated UV-sensitive cross-linking agent.

In some embodiments, the step S2 further includes mixing a nano-reinforced material with the meltable PAN-based copolymer and the flow modifier during mixing; the nano-reinforced material is 0-5.0% of the mass of the meltable PAN-based copolymer.

In further embodiments, the nano-reinforced material includes at least one of MXene, carbon nanotubes, graphene, and graphene oxide.

In further embodiments, in the step S2, the flow modifier includes at least one of low molecular weight PAN copolymer, mesophase pitch, and glycerol.

In further embodiments, in the step S2, the mass ratio of the flow modifier to the meltable PAN-based copolymer is 0-1:1.

In further embodiments, the number-average molecular weight (Mn) of the low molecular weight PAN copolymer is 1000-50000.

In further embodiments, the low molecular weight PAN copolymer is prepared by the following steps:

an acrylonitrile, a second monomer and an unsaturated UV-sensitive cross-linking agent are mixed, an excessive amount of initiator was added, a reaction was performed to obtain a low molecular weight PAN copolymer.

In some embodiments, the mole ratio of the acrylonitrile, the second monomer and the unsaturated UV-sensitive cross-linking agent is 60-89:10-30:0-20; the mole percentage of the initiator to the polymerized monomer is 0.1-2%, the polymerized monomer is the sum of the acrylonitrile, the second monomer and the unsaturated UV-sensitive cross-linking agent.

In further embodiments, in the step S2, the temperature of the melt spinning is 170-230° C., the stretching temperature is 100-170° C., and the stretching ratio is 4-30 times, the annealing temperature is 100-140° C., and the annealing time is 1-6 hours.

In further embodiments, in the step S3, the ultraviolet irradiation time is 1 s-4 h, the light source generated by the ultraviolet irradiation equipment is 5-30 cm away from the PAN-based carbon fiber precursor.

In further embodiments, in the step S4, pre-oxidation is performed in hot air of 180-270° C.

In further embodiments, a nitrogen is heated to 1000-1200° C. to carbonize the pre-oxidized PAN fibers.

The present disclosure has the following advantages:

(1) The method of preparing PAN-based carbon fibers provided in the present disclosure adopts an emulsion polymerization method to prepare a meltable PAN-based copolymer, with using acrylonitrile, a second monomer and an unsaturated UV-sensitive crosslinking agent. Then, after the meltable PAN-based copolymer and the flow modifier are fully blended, the PAN-based carbon fiber precursor is prepared by the melt spinning method. Since the precursor contains a UV-sensitive crosslinking agent, the flow modifier and the meltable PAN-based copolymer undergo a crosslinking reaction under UV irradiation treatment. The resulting ladder-shaped crosslinking fiber can not only effectively maintain the fiber shape, but also does not melt at high temperature. Finally, densely structured PAN-based carbon fibers are obtained after pre-oxidation and carbonization.

The above method effectively realizes the preparation of PAN-based carbon fiber precursor by melt spinning method, significantly reduces the production cost of the precursor, the process is simple, environmentally friendly, and provides a new method for the low-cost preparation of PAN-based carbon fibers, which has high industrial application value and market prospects.

(2) In the method of preparing PAN-based carbon fibers provided in the present disclosure, a specific flow modifier is added to improve the melt flowability of the PAN raw materials, which includes low molecular weight PAN copolymer, mesophase pitch, glycerol and the like. As to the low molecular weight PAN copolymer, the better the melting properties and the stronger plasticizing effect. Moreover, the low molecular weight PAN copolymer can undergo a cyclization reaction with the PAN raw material during the pre-oxidation process and merge into the molecular chain to form a network structure and reduce the occurrence of defects. Mesophase pitch is a kind of carbon fiber precursor, which can be transformed into carbon fibers at high temperature without causing void defects in the final carbonized fibers. Glycerol, decomposed in the pre-oxidation stage, can be separated from the PAN fibers, thus relieving plasticizing effect to avoid the PAN fibers melting.

(3) In the method of preparing PAN-based carbon fibers provided in the present disclosure, the addition of nano-reinforced materials enables the resulting fibers have higher strength. The nano-reinforced materials can induce PAN crystallization acting as heterogeneous nucleating agents, increase crystallinity, and enhance the strength of PAN. At the same time, the nano-particle effect of the carbon nano-reinforced materials greatly improve the mechanical properties of the fibers.

BRIEF DESCRIPTION OF THE DRAWINGS

The drawings constituting a part of the present disclosure are used to provide a further understanding of the present disclosure, and the exemplary embodiments of the present disclosure and the description thereof are used to explain the present disclosure, and do not constitute an improper limitation of the present disclosure. In the attached figures.

DETAILED DESCRIPTION

Figure 1:
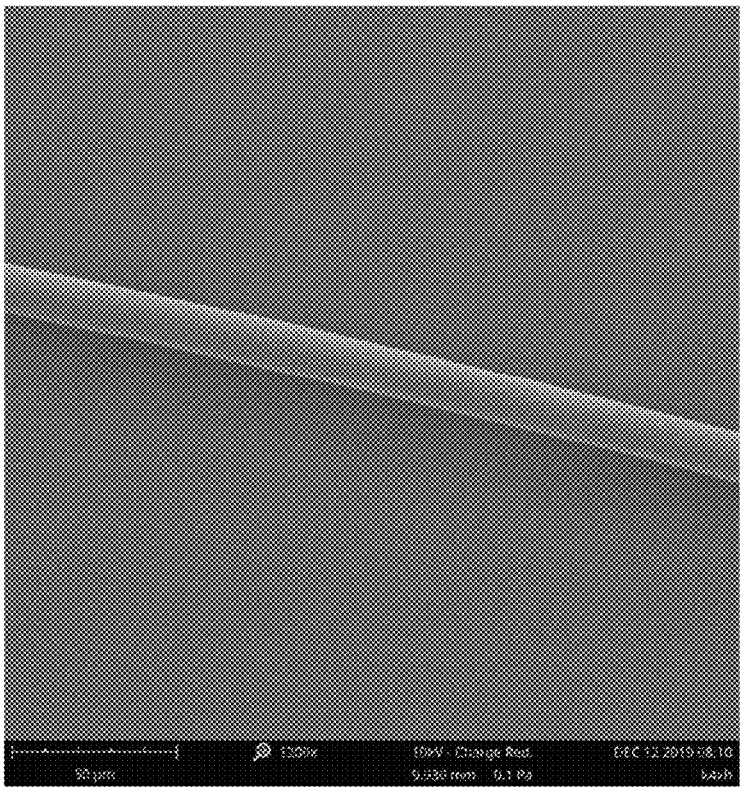
FIG. 1 shows a scanning electron microscope (SEM) image obtained in Embodiment 3 of the present disclosure.
Figure 2:
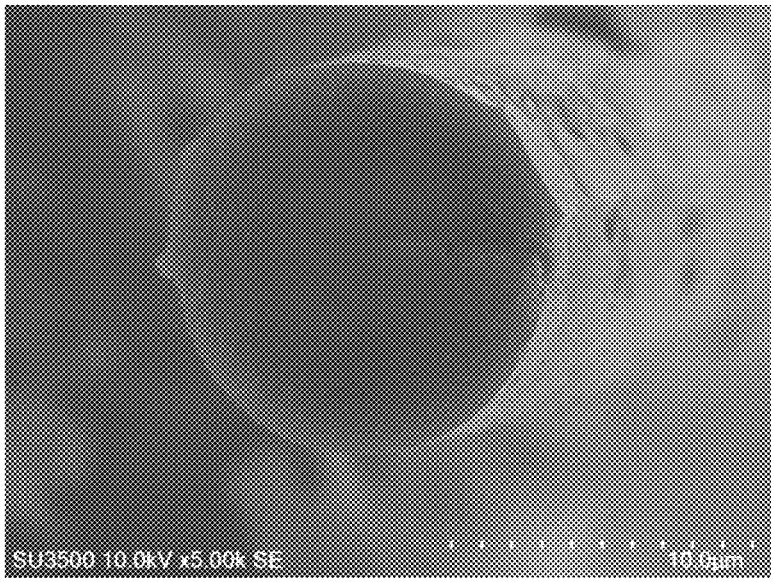
FIG. 2 shows a cross-sectional view of a scanning electron microscope (SEM) image obtained in Embodiment 3 of the present disclosure.

As far as the inventors known, ionic liquid used to plasticize PAN-based polymer is difficult to separate from the precursor, which leads carbonized fibers to form defects and greatly reduces the mechanical properties of the fibers; if using comonomers for plasticization, there are many problems such as lots of polymerization reaction parameters, poor repeatability, and unsatisfactory melting effect, and it is also difficult to industrialize and mass-produce; in some solutions, an external plasticizer is used, but this method is prone to secondary melting when the temperature is raised during the pre-oxidation stage, resulting in structural collapse and cannot be used to prepare PAN-based carbon fibers.

The technical solutions in the embodiments of the present disclosure will be clearly and completely described below in conjunction with the embodiments of the present disclosure. Obviously, the described embodiments are only a part of the embodiments of the present disclosure, rather than all the embodiments. In the case of no conflict, the embodiments of the present disclosure and the features in the embodiments can be combined with each other.

The present disclosure provides a method of preparing PAN-based carbon fibers, in at least one embodiment, the method includes the following steps:

S1. an acrylonitrile (M1), a second monomer (M2) and a third monomer (an unsaturated UV-sensitive cross-linking agent, M3) are mixed, an initiator is then added and a reaction is performed to obtain a meltable PAN-based copolymer;

S2. the meltable PAN-based copolymer and a flow modifier are mixed to obtain a mixture, the mixture is extruded and pelletized, and then melt spinning is performed to obtain nascent fibers, the nascent fibers are stretched and annealed to obtain a PAN-based carbon fiber precursor;

S3. ultraviolet irradiation is performed on the PAN-based carbon fiber precursor;

S4. the PAN-based carbon fiber precursor after ultraviolet irradiation is pre-oxidized and carbonized to obtain PAN-based carbon fibers.

In the method of preparing PAN-based carbon fibers proposed in the embodiments of the present disclosure, the UV-sensitive cross-linking agent is introduced to prepare the meltable PAN-based copolymer, and at the same time, a flow modifier is added to further increase the melt flowability of the PAN-based copolymer, decrease the spinning temperature and improve the melt flow properties of PAN raw materials. Under ultraviolet irradiation, the PAN-based carbon fiber precursor undergoes cross-linking reaction to form crosslinking fibers, which can effectively improve the shape stability of the fibers; and after pre-oxidation and carbonization treatment, PAN-based carbon fibers with dense structure can finally be obtained.

The method proposed in the embodiments of the present disclosure can effectively realize the preparation of PAN-based carbon fiber precursor by melt spinning, significantly reduce the production cost of carbon fiber precursor; and the process is simple and environmentally friendly, which provides a new idea of preparing PAN-based carbon fibers with low cost and has high industrial application value.

In some embodiments of the present disclosure, the step S1 is aimed at preparing a meltable PAN-based copolymer by emulsion polymerization method, with using acrylonitrile, the second monomer and the unsaturated ultraviolet light-sensitive cross-linking agent. The introduction of flexible monomers into the PAN molecular chain makes the PAN-based copolymer has melt-processibility. At the same time, the introduction of the third monomer unsaturated UV-sensitive cross-linking agent into the copolymer molecules can significantly improve the thermodynamic stability of the precursor during the subsequent ultraviolet irradiation treatment.

In some embodiments of the present disclosure, in the step S1, the second monomer includes at least one of methyl acrylate (MA), methyl methacrylate (MMA), itaconic acid (IA), and vinyl imidazole (VIM). For example, in at least one embodiment, the second monomer is only methyl acrylate (MA), while in some embodiments, the second monomer is a mixture of methyl acrylate (MA), methyl methacrylate (MMA) and the like.

In some embodiments of the present disclosure, in the step S1, the unsaturated UV-sensitive cross-linking agent includes at least one of 4-acryloxybenzophenone (ABP), 2-hydroxy-4-acryloxybenzophenone (AHBP), 2-hydroxy-4-methoxybenzophenone (OBZ), 4-benzoylphenyl methacrylate (BPM), and octadecanophenone (OCP). For example, in at least one embodiment, the unsaturated UV-sensitive cross-linking agent is only ABP, while in some embodiments, the unsaturated UV-sensitive cross-linking agent is a mixture of OBZ, BPM and the like. Because of the unsaturated UV-sensitive cross-linking agent, the crosslinking reaction can further occur under ultraviolet irradiation.

In some embodiments of the present disclosure, in the step S1, the initiator includes at least one of ammonium persulfate ($(NH_4)_2S_2O_8$) and azobisisobutyronitrile (AIBN). For example, in at least one embodiment, the initiator is ammonium persulfate ($(NH_4)_2S_2O_8$), while in some embodiments, the initiator is a mixture of ammonium persulfate ($(NH_4)_2S_2O_8$) and azobisisobutyronitrile (AIBN).

In some embodiments of the present disclosure, the mole percentage of the initiator to the polymerized monomer is 0.05-0.1%, wherein, the polymerized monomer is the sum of the acrylonitrile, the second monomer and the unsaturated UV-sensitive cross-linking agent. Specifically, the mole percentage of the initiator to the polymerized monomer is, but not limited to: 0.05%, 0.06%, 0.07%, 0.08%, 0.09%, 0.1%, etc. Under this ratio, a meltable PAN-based copolymer can be finally obtained.

In some embodiments of the present disclosure, in the step S1, the mole percentage of the acrylonitrile, the second monomer, and the unsaturated UV-sensitive cross-linking agent is 85-95:5-15:0-5. In accordance with some embodiments, the mole percentage of the acrylonitrile, the second monomer, and the unsaturated UV-sensitive cross-linking agent is 85-90:10-15:0-3. In at least one embodiment, the mole percentage of the acrylonitrile, the second monomer, and the unsaturated UV-sensitive cross-linking agent is 85:14:1. In some embodiments, the mole percentage of the acrylonitrile, the second monomer, and the unsaturated UV-sensitive cross-linking agent is, but not limited to: 85:14:1, 88:11:1, 89:9:2, 90:10:0, 86:11:3, 85:15:0, etc. However, in some embodiments, the mole percentage of the unsaturated UV-sensitive cross-linking agent is 0, the flow modifier is a low molecular weight PAN copolymer containing unsaturated UV-sensitive cross-linking agent.

In some embodiments of the present disclosure, in the step S1, the reaction temperature is 50-80° C. and the reaction time is 1-8 h. In accordance with some embodiments, the reaction temperature is, but not limited to: 50° C., 60° C., 70° C., 80° C., and so on; the reaction time is, but not limited to: 1 h, 2 h, 3 h and so on.

In some embodiments of the present disclosure, the melting temperature of the meltable PAN-based copolymer obtained by the step S1 is 150-220° C., and the melt index (MI) is 7-70 g/10 min.

In some embodiments of the present disclosure, in the step S2, the meltable PAN-based copolymer and the flow modifier are mixed, because the two have good compatibility, the melt flow properties can be significantly improved, which is beneficial to use melt spinning method to prepare PAN-based carbon fiber precursor, and greatly reduces the preparation cost of the precursor. Compared with the traditional wet spinning method for preparing precursors, the melt spinning has the advantages of higher production efficiency, green and environmentally friendly production process and the like. Moreover, fibers with various special-shaped cross-sections can be prepared, and solvents are not required in the spinning process, thus saving manpower and material resources.

In some embodiments of the present disclosure, in the step S2, the mass ratio of the flow modifier to the meltable PAN-based copolymer is 0-1:1. In accordance with some embodiments, the mass ratio of the flow modifier to the meltable PAN-based copolymer is, but not limited to: 0.2:1, 0.4:1, 0.6:1, 0.8:1, etc. In some embodiments, when the adding amount of the flow modifier is 0, the adding amount of the unsaturated UV-sensitive cross-linking agent in the step S1 is not 0, which facilitates subsequent crosslinking.

In some embodiments of the present disclosure, in the step S2, the flow modifier includes at least one of low molecular weight PAN copolymer, mesophase pitch (MP), and glycerol. Among them, the number-average molecular weight (Mn) of the low molecular weight PAN copolymer is 1000-50000. The three flow modifiers selected in the embodiments of the present disclosure all have excellent effects, good compatibility with PAN raw materials, which can greatly improve the melt flow properties of PAN raw materials.

In some embodiments, the melting point of the MP is 110-180° C. Since the MP is also a kind of carbon fiber precursor, it can be transformed into carbon fibers at high temperature without causing void defects in the final carbonized fibers;

the glycerol is decomposed in the pre-oxidation stage and can be separated from the PAN fibers, thus relieving plasticizing effect to avoid the PAN fibers melting;

as to the low molecular weight PAN copolymer, the lower the molecular weight of the PAN copolymer, the better the melting properties and the stronger plasticizing effect. Moreover, the low molecular weight PAN copolymer can undergo a cyclization reaction with the PAN raw material during the pre-oxidation process and merge into the molecular chain to form a network structure and reduce the occurrence of defects.

In further embodiments, the preparation method of the low molecular weight PAN copolymer is same as the preparation method of the meltable PAN-based copolymer in the step S1, except that an excessive amount of the initiator needs to be added to prepare the low molecular weight PAN copolymer.

In some embodiments, the low molecular weight PAN copolymer is prepared by the following steps:

an acrylonitrile, a second monomer and an unsaturated UV-sensitive cross-linking agent are mixed, an excessive amount of initiator was added, a reaction was performed to obtain a low molecular weight PAN copolymer;

In accordance with some embodiments, the mole ratio of the acrylonitrile, the second monomer and the unsaturated UV-sensitive cross-linking agent is 60-89:10-30:0-20; the mole percentage of the initiator to the polymerized monomer is 0.1-2%, the polymerized monomer is the sum of the acrylonitrile, the second monomer and the unsaturated UV-sensitive cross-linking agent. The amount of initiator added here needs to be excessive, so that a low molecular weight PAN copolymer that meets the requirements is finally prepared. In some embodiments, the mole percentage of the initiator to the polymerized monomer is, but not limited to 0.1%, 0.5%, 1%, 1.5%, 2%, and so on.

In further embodiments of the present disclosure, in the step S1, the mole percentage of the acrylonitrile, the second monomer, and the unsaturated UV-sensitive cross-linking agent is 85-95:5-15:0-5; and the flow modifier is low molecular weight PAN copolymer. In at least one embodiment of the present disclosure, the addition amount of the unsaturated UV-sensitive cross-linking agent is 0, the flow modifier is the low molecular weight PAN-based copolymer, which can give UV-crosslinking properties to PAN raw materials without UV-crosslinking properties. When the addition amount of the unsaturated UV-sensitive cross-linking agent is not 0, the low molecular weight PAN copolymer as the flow modifier can also enhance its UV-crosslinking properties. At the same time, when the low molecular weight PAN copolymer is used as a plasticizer, it can participate in the cyclization reaction at high temperature to form a ladder structure, which is beneficial to obtain PAN-based carbon fibers with a dense structure.

In some embodiments of the present disclosure, the step S2 further includes mixing a nano-reinforced material with the meltable PAN-based copolymer and the flow modifier during mixing.

In further embodiments, in the step S2, the nano-reinforced material includes at least one of MXene, carbon nanotubes, graphene (GR), and graphene oxide (GO), wherein the carbon nanotubes include at least one of single-walled carbon nanotubes, double-walled carbon nanotubes, multi-walled carbon nanotubes, carboxylated carbon nanotubes, hydroxylated carbon nanotubes, and aminated carbon nanotubes (AMWNTs).

In some embodiments, the nano-reinforced material is 0-5.0% of the mass of the meltable PAN-based copolymer. In accordance with some embodiments, the nano-reinforced material is 0.1%, 0.5%, 1%, 1.5%, 2%, 2.5%, 3%, 3.5%, 4%, 4.5%, 5% of the mass of the meltable PAN-based copolymer. Addition of nano-reinforced materials enables the resulting fibers have higher strength. The nano-reinforced materials induce PAN crystallization acting as heterogeneous nucleating agents, increase crystallinity, and enhance the strength of PAN. At the same time, the nano-particle effect of the carbon nano-reinforced material greatly improves the mechanical properties of the fibers.

In some embodiments of the present disclosure, in the step S2, the melt spinning is performed in a twin-screw spinning machine, the rotation speed of the screw is 40-120 r/min; the temperature of the melt spinning is 170-230° C.

In some embodiments of the present disclosure, in the step S2, the stretching temperature is 100-170° C., and the stretching ratio is 4-30 times, that is the length after stretching is 4-30 times of the length before stretching; in some embodiments, the stretching temperature is, but not limited to: 100° C., 110° C., 120° C., 130° C., 140° C., 150° C., 160° C., 170° C., etc; the stretching ratio is, but not limited to: 4, 5, 6, 7, 8, 9, 10, 15, 20, 25, 30 times, and so on.

In some embodiments, the annealing temperature is 100-140° C., and the annealing time is 1-6 hours. In accordance with some embodiments, the annealing temperature is, but not limited to: 100° C., 110° C., 120° C., 130° C., 140° C. and so on; the annealing time is, but not limited to: 1 h, 2 h, 3 h, 4 h, 5 h, 6 h and so on. The stretching and annealing process improves the fibers orientation and the regularity of the nascent fibers, further greatly improves the mechanical properties of the final carbon fibers.

In some embodiments of the present disclosure, in the step S3, in the presence of the UV-sensitive cross-linking agent, ultraviolet irradiation treatment can cause the flow modifier and the meltable PAN-based copolymer to undergo a cross-linking reaction, and the resulting ladder-shaped crosslinking fibers can effectively maintain the fiber shape.

In some embodiments of the present disclosure, in the step S3, the power of the ultraviolet irradiation equipment is 0.1-4 kW, and the ultraviolet irradiation time is but not limited to: 1 s-4 h. In accordance with some embodiments, the ultraviolet irradiation time is, but not limited to: 1 s, 10 s, 30 s, 1 h, 2 h, 3 h, 4 h, etc. The light source generated by the ultraviolet irradiation equipment is 20-30 cm away from the PAN-based carbon fiber precursor; in at least one embodiment, the light source generated by the ultraviolet irradiation equipment is 24 cm away from the PAN-based carbon fiber precursor, the wavelength of the light source generated by the equipment is 200-300 nm.

In some embodiments of the present disclosure, in the step S4, since the ladder-shaped crosslinking fibers treated by ultraviolet irradiation can effectively maintain the fiber shape, they will not melt at high temperature, and will not cause secondary melting and structural collapse, which facilitates to obtain PAN-based carbon fibers with a dense structure after pre-oxidation and carbonization treatment.

In some embodiments of the present disclosure, in the step S4, pre-oxidation is performed in hot air of 180-270° C. In accordance with some embodiments, the pre-oxidation is performed in the hot air of, but not limited to: 180° C., 200° C., 230° C., 250° C., 270° C., etc.

In some embodiments of the present disclosure, in the step S4, a nitrogen is heated to 1000-1200° C. to carbonize the pre-oxidized PAN fibers. Carbonization is performed, but not limited to, heating nitrogen to 1000° C., 1100° C., 1200° C. and so on.

The present disclosure is more specifically described below in conjunction with the following embodiments.

Embodiment 1

A method of preparing PAN-based carbon fibers, includes the following steps:

S0: Preparation of a Flow Modifier

An acrylonitrile (AN), a second monomer methyl acrylate (MA), and 4-acryloyloxybenzophenone (ABP) with a mole ratio of 85:14:1 were added into a three-necked flask equipped with a heating device and heated to 60° C.; subsequently, ammonium persulfate (wherein the mole ratio of the ammonium persulfate to the polymerized monomer was 0.1%) was added to initiate a reaction, and the reaction time was 2 h; the reaction product was then washed and dried to obtain a low molecular weight PAN copolymer, also known as a plasticizer.

S1: Preparation of Meltable PAN Copolymer

AN and MA with a mole ratio of 85:15 were added into a reactor equipped with a heating device, then ammonium persulfate (the mole ratio of the ammonium persulfate to the polymerized monomer is 0.05%) was added, a reaction temperature was 50° C., and an emulsion polymerization method was used to prepare meltable PAN copolymer.

S2: Melt Spinning

The plasticizer obtained by the step S0 as a polymer flow modifier and the PAN copolymer obtained by the step S1 were added into a mixer to mix, with a mass of the flow modifier is 20% of the mixture; the mixture was then extruded and pelletized by a screw extruder; and further melt spinning was performed by a twin-screw spinning machine, with a screw speed was 40-120 r/min, and a spinning temperature was 210° C.; the spun fibers were stretched in air at a stretching temperature of 170° C. and a stretching ratio of 30 times, and then annealed in air, an annealing temperature was 140° C. and an annealing time was 6 h.

S3: Ultraviolet Irradiation Treatment

The stretched fibers were put into an ultraviolet irradiation device with a power of 2 kW and were irradiated for 2 h, where the fibers were 24 cm away from the light source.

S4: Heat Treatment

The irradiated fibers were pre-oxidized in a hot air of 230° C. for 2 h to obtain PAN pre-oxidized fibers, the pre-oxidized fibers were then carbonized in nitrogen at a heating rate of 5° C./min to 1200° C. to obtain PAN-based carbon fibers.

Embodiment 2

A method of preparing PAN-based carbon fibers, includes the following steps:

S1: Preparation of Meltable PAN Copolymer

AN, MA and AHBP with a mole ratio of 85:14:1 were added into a reactor equipped with a heating device, then ammonium persulfate (the mole ratio of the ammonium persulfate to the polymerized monomer is 0.075%) was added, a reaction temperature was 65° C., and an emulsion polymerization method was used to prepare meltable PAN copolymer.

S2: Melt Spinning

The mesophase pitch (MP) as a polymer flow modifier and the PAN copolymer obtained by the step S1 were added into a mixer to mix, with a mass of the flow modifier is 1% of the mixture; the mixture was mixed with graphene (the mass of the graphene is 0.1% of the PAN copolymer), and was then extruded and pelletized by a screw extruder; and further melt spinning was performed by a twin-screw spinning machine, with a screw speed was 40-120 r/min, and a spinning temperature was 230° C.; the spun fibers were stretched in air at a stretching temperature of 140° C. and a stretching ratio of 15 times, and then annealed in air, an annealing temperature was 120° C. and an annealing time was 4 h.

S3: Ultraviolet Irradiation Treatment

The stretched fibers were put into an ultraviolet irradiation device with a power of 0.1 kW and were irradiated for 1 s, where the fibers were 20 cm away from the light source.

S4: Heat Treatment

The irradiated fibers were pre-oxidized in a hot air of 180° C. for 2 h to obtain PAN pre-oxidized fibers, the pre-oxidized fibers were then carbonized in nitrogen at a heating rate of 5° C./min to 1000° C. to obtain PAN-based carbon fibers.

Embodiment 3

A method of preparing PAN-based carbon fibers, includes the following steps:

S1: Preparation of Meltable PAN Copolymer

AN, MA and BPM with a mole ratio of 90:8:2 were added into a reactor equipped with a heating device, then ammonium persulfate (the mole ratio of the ammonium persulfate to the polymerized monomer is 0.1%) was added, a reaction temperature was 80° C., and an emulsion polymerization method was used to prepare meltable PAN copolymer.

S2: Melt Spinning

The glycerol as a polymer flow modifier and the PAN copolymer obtained by the step S1 were added into a mixer to mix, with a mass of the flow modifier is 50% of the mixture; the mixture was mixed with graphene (the mass of the graphene is 2.5% of the PAN copolymer), and was then extruded and pelletized by a screw extruder; and further melt spinning was performed by a twin-screw spinning machine, with a screw speed was 40-120 r/min, and a spinning temperature was 170° C.; the spun fibers were stretched in air at a stretching temperature of 100° C. and a stretching ratio of 4 times, and then annealed in air, an annealing temperature was 100° C. and an annealing time was 1 h.

S3: Ultraviolet Irradiation Treatment

The stretched fibers were put into an ultraviolet irradiation device with a power of 4 kW and were irradiated for 4 h, where the fibers were 30 cm away from the light source.

S4: Heat Treatment

The irradiated fibers were pre-oxidized in hot air of 270° C. for 2 h to obtain PAN pre-oxidized fibers, the pre-oxidized fibers were then carbonized in nitrogen at a heating rate of 5° C./min to 1200° C. to obtain PAN-based carbon fibers.

Embodiment 4

A method of preparing PAN-based carbon fibers, includes the following steps:

S0: Preparation of a Flow Modifier

AN, MA and OCP with a mole ratio of 85:14:1 were added into a three-necked flask equipped with a heating device and heated to 60° C.; subsequently, ammonium persulfate (wherein the mole ratio of the ammonium persulfate to polymerized monomer was 1%) was added to initiate a reaction, and a reaction time was 2 h; a reaction product was then washed and dried to obtain a low molecular weight PAN copolymer, also known as a plasticizer.

S1: Preparation of Meltable PAN Copolymer

AN, MA and OCP with a mole ratio of 90:7:3 were added into a reactor equipped with a heating device, then ammonium persulfate (the mole ratio of the ammonium persulfate to the polymerized monomer was 0.05%) was added, a reaction temperature was 65° C., and an emulsion polymerization method was used to prepare meltable PAN copolymer.

S2: Melt Spinning

The plasticizer and glycerol with a mass ratio of 1:1 used as a polymer flow modifier were mixed with the PAN copolymer obtained by the step S1 in a mixer, with a mass of the flow modifier is 20% of the mixture; the mixture was then mixed with graphene (the mass of the graphene is 5% of the PAN copolymer), and was then extruded and pelletized by a screw extruder; and further melt spinning was performed by a twin-screw spinning machine, with a screw speed was 40-120 r/min, and a spinning temperature was 210° C.; the spun fibers were stretched in air at a stretching temperature of 140° C. and a stretching ratio of 15 times, and then annealed in air, an annealing temperature was 120° C. and an annealing time was 4 h.

S3: Ultraviolet Irradiation Treatment

The stretched fibers were put into an ultraviolet irradiation device with a power of 2 kW and were irradiated for 2 h, where the fibers were 25 cm away from the light source.

S4: Heat Treatment

The irradiated fibers were pre-oxidized in a hot air of 265° C. for 2 h to obtain PAN pre-oxidized fibers, the pre-oxidized fibers were then carbonized in nitrogen at a heating rate of 5° C./min to 1200° C. to obtain PAN-based carbon fibers.

Embodiment 5

A method of preparing PAN-based carbon fibers, includes the following steps:

S0: Preparation of a Flow Modifier

AN, MA and OBZ with a mole ratio of 80:10:10 were added into a three-necked flask equipped with a heating device and heated to 60° C.; subsequently, ammonium persulfate (wherein the mole ratio of the ammonium persulfate to polymerized monomer was 2%) was added to initiate a reaction, and a reaction time was 2 h; a reaction product was then washed and dried to obtain a low molecular weight PAN copolymer, also known as a plasticizer.

S1: Preparation of Meltable PAN Copolymer

AN, MA and ABP with a mole ratio of 90:6:4 were added into a reactor equipped with a heating device, then ammonium persulfate (the mole ratio of the ammonium persulfate to the polymerized monomer is 0.05%) was added, with a reaction temperature was 65° C., and an emulsion polymerization method was used to prepare meltable PAN copolymer.

S2: Melt Spinning

The plasticizer, glycerol and mesophase pitch with a mass ratio of 1:1:1 used as a polymer flow modifier were mixed with the PAN copolymer obtained by the step S1 in a mixer, with a mass of the flow modifier is 20% of the mixture; the mixture was then mixed with graphene oxide (the mass of the graphene oxide is 0.1% of the PAN copolymer), and was then extruded and pelletized by a screw extruder; and further melt spinning was performed by a twin-screw spinning machine, with a screw speed was 40-120 r/min, and a spinning temperature was 210° C.; the spun fibers were stretched in air at a stretching temperature of 140° C. and a stretching ratio of 15 times, and then annealed in air, an annealing temperature was 120° C. and an annealing time was 4 h.

S3: Ultraviolet Irradiation Treatment

The stretched fibers were put into an ultraviolet irradiation device with a power of 2 kW and were irradiated for 2 h, where the fibers were 24 cm away from the light source.

S4: Heat Treatment

The irradiated fibers were pre-oxidized in hot air of 265° C. for 2 h to obtain PAN pre-oxidized fibers, the pre-oxidized fibers were then carbonized in nitrogen at a heating rate of 5° C./min to 1200° C. to obtain PAN-based carbon fibers.

Embodiment 6

A method of preparing PAN-based carbon fibers, includes the following steps:

S0: Preparation of a Flow Modifier

AN, MA and ABP with a mole ratio of 70:20:10 were added into a three-necked flask equipped with a heating device and heated to 60° C.; subsequently, ammonium persulfate (wherein the mole ratio of the ammonium persulfate to polymerized monomer was 0.1%) was added to initiate a reaction, and a reaction time was 2 h; a reaction product was then washed and dried to obtain a low molecular weight PAN copolymer, also known as a plasticizer.

S1: Preparation of Meltable PAN Copolymer

AN, MA and OCP with a mole ratio of 90:5:5 were added into a reactor equipped with a heating device, then ammonium persulfate (the mole ratio of the ammonium persulfate to the polymerized monomer is 0.05%) was added, a reaction temperature was 65° C., and an emulsion polymerization method was used to prepare meltable PAN copolymer.

S2: Melt Spinning

The plasticizer as a polymer flow modifier and the PAN copolymer obtained by the step S1 were added into a mixer to mix, with a mass of the flow modifier is 20% of the mixture; the mixture was then mixed with graphene oxide (the mass of the graphene oxide is 2.5% of the PAN copolymer), and was then extruded and pelletized by a screw extruder; and further melt spinning was performed by a twin-screw spinning machine, with a screw speed was 40-120 r/min, and a spinning temperature was 210° C.; the spun fibers were stretched in air at a stretching temperature of 140° C. and a stretching ratio of 15 times, and then annealed in air, an annealing temperature was 120° C. and an annealing time was 4 h.

S3: Ultraviolet Irradiation Treatment

The stretched fibers were put into an ultraviolet irradiation device with a power of 2 kW and were irradiated for 2 h, where the fibers were 24 cm away from the light source.

S4: Heat Treatment

The irradiated fibers were pre-oxidized in hot air of 265° C. for 2 h to obtain PAN pre-oxidized fibers, the pre-oxidized fibers were then carbonized in nitrogen at a heating rate of 5° C./min to 1200° C. to obtain PAN-based carbon fibers.

Embodiment 7

A method of preparing PAN-based carbon fibers, includes the following steps:

S0: Preparation of a Flow Modifier

AN, MA and AHBP with a mole ratio of 60:20:20 were added into a three-necked flask equipped with a heating device and heated to 60° C.; subsequently, ammonium persulfate (wherein the mole ratio of the ammonium persulfate to polymerized monomer was 0.1%) was added to initiate a reaction, and a reaction time was 2 h; a reaction product was then washed and dried to obtain a low molecular weight PAN copolymer, also known as a plasticizer.

S1: Preparation of Meltable PAN Copolymer

AN and MA with a mole ratio of 90:10 were added into a reactor equipped with a heating device, then ammonium persulfate (the mole ratio of the ammonium persulfate to the polymerized monomer is 0.05%) was added, a reaction temperature was 65° C., and an emulsion polymerization method was used to prepare meltable PAN copolymer.

S2: Melt Spinning

The plasticizer used as a polymer flow modifier and the PAN copolymer obtained by the step S1 were added into a mixer to mix, with a mass of the flow modifier is 20% of the mixture; the mixture was then mixed with graphene oxide (the mass of the graphene oxide is 5% of the PAN copolymer), and was then extruded and pelletized by a screw extruder; and further melt spinning was performed by a twin-screw spinning machine, with a screw speed was 40-120 r/min, and a spinning temperature was 210° C.; the spun fibers were stretched in air at a stretching temperature of 140° C. and a stretching ratio of 15 times, and then annealed in air, an annealing temperature was 120° C. and an annealing time was 4 h.

S3: Ultraviolet Irradiation Treatment

The stretched fibers were put into an ultraviolet irradiation device with a power of 2 kW and were irradiated for 2 h, where the fibers were 24 cm away from the light source.

S4: Heat Treatment

The irradiated fibers were pre-oxidized in hot air of 265° C. for 2 h to obtain PAN pre-oxidized fibers, the pre-oxidized fibers were then carbonized in nitrogen at a heating rate of 5° C./min to 1200° C. to obtain PAN-based carbon fibers.

Embodiment 8

A method of preparing PAN-based carbon fibers, includes the following steps:

S0: Preparation of a Flow Modifier

AN, MA and ABP with a mole ratio of 60:30:10 were added into a three-necked flask equipped with a heating device and heated to 60° C.; subsequently, ammonium persulfate (wherein the mole ratio of the ammonium persulfate to polymerized monomer was 0.1%) was added to initiate a reaction, and a reaction time was 2 h; a reaction product was then washed and dried to obtain a low molecular weight PAN copolymer, also known as a plasticizer.

S1: Preparation of Meltable PAN Copolymer

AN and MA with a mole ratio of 95:5 were added into a reactor equipped with a heating device, then ammonium persulfate (the mole ratio of the ammonium persulfate to the polymerized monomer is 0.05%) was added, a reaction temperature was 65° C., and an emulsion polymerization method was used to prepare meltable PAN copolymer.

S2: Melt Spinning

The plasticizer as a polymer flow modifier and the PAN copolymer obtained by the step S1 were added into a mixer to mix, with a mass of the flow modifier is 20% of the mixture; the mixture was then mixed with aminated carbon nanotubes (the mass of the aminated carbon nanotubes is 0.1% of the PAN copolymer), and was then extruded and pelletized by a screw extruder; and further melt spinning was performed by a twin-screw spinning machine, with a screw speed was 40-120 r/min, and a spinning temperature was 210° C.; the spun fibers were stretched in air at a stretching temperature of 140° C. and a stretching ratio of 15 times, and then annealed in air, an annealing temperature was 120° C. and an annealing time was 4 h.

S3: Ultraviolet Irradiation Treatment

The stretched fibers were put into an ultraviolet irradiation device with a power of 2 kW and were irradiated for 2 h, where the fibers were 24 cm away from the light source.

S4: Heat Treatment

The irradiated fibers were pre-oxidized in hot air of 265° C. for 2 h to obtain PAN pre-oxidized fibers, the pre-oxidized fibers were then carbonized in nitrogen at a heating rate of 5° C./min to 1200° C. to obtain PAN-based carbon fibers.

Embodiment 9

A method of preparing PAN-based carbon fibers:

same as Embodiment 8, except that the aminated carbon nanotubes in the step S2 was 2.5% by mass of the PAN copolymer.

Embodiment 10

A method of preparing PAN-based carbon fibers:

same as Embodiment 8, except that the aminated carbon nanotubes in the step S2 was 5% by mass of the PAN copolymer.

Embodiment 11

A method of preparing PAN-based carbon fibers:

same as Embodiment 1, except that the mole ratio of AN, MA and ABP in the step S0 was 89:10:1.

Embodiment 12

A method of preparing PAN-based carbon fibers:

same as Embodiment 1, except that the mole ratio of AN, MA and ABP in the step S0 was 69:30:1.

Embodiment 13

A method of preparing PAN-based carbon fibers:

same as Embodiment 1, except that the mole ratio of AN, MA and ABP in the step S0 was 80:10:10.

Embodiment 14

A method of preparing PAN-based carbon fibers:

same as Embodiment 1, except that the mole ratio of AN, MA and ABP in the step S0 was 60:20:20.

Embodiment 15

A method of preparing PAN-based carbon fibers:
same as Embodiment 1, except that the mole ratio of AN, MA and ABP in the step S0 was 60:30:10.

Embodiment 16

A method of preparing PAN-based carbon fibers:
same as Embodiment 1, except that the mole ratio of the ammonium persulfate to the polymerized monomer in the step S0 was 1%.

Embodiment 17

A method of preparing PAN-based carbon fibers:
same as Embodiment 1, except that the mole ratio of the ammonium persulfate to the polymerized monomer in the step S0 was 2%.

Embodiment 18

A method of preparing PAN-based carbon fibers:
same as Embodiment 1, except that the mass of the flow modifier in the step S2 was 1% of the mixture.

Embodiment 19

A method of preparing PAN-based carbon fibers:
same as Embodiment 1, except that the mass of the flow modifier in the step S2 was 50% of the mixture.

Embodiment 20

A method of preparing PAN-based carbon fibers:
same as Embodiment 1, except that the stretching temperature in the step S2 was 140° C.

Embodiment 21

A method of preparing PAN-based carbon fibers:
same as Embodiment 1, except that the stretching temperature in the step S2 was 100° C.

Embodiment 22

A method of preparing PAN-based carbon fibers:
same as Embodiment 1, except that the stretching ratio in the step S2 was 15 times.

Embodiment 23

A method of preparing PAN-based carbon fibers:
same as Embodiment 1, except that the stretching ratio in the step S2 was 4 times.

Embodiment 24

A method of preparing PAN-based carbon fibers:
same as Embodiment 1, except that the annealing temperature in the step S2 was 120° C.

Embodiment 25

A method of preparing PAN-based carbon fibers:
same as Embodiment 1, except that the annealing temperature in the step S2 was 100° C.

Embodiment 26

A method of preparing PAN-based carbon fibers:
same as Embodiment 1, except that the annealing time in the step S2 was 4 h.

Embodiment 27

A method of preparing PAN-based carbon fibers:
same as Embodiment 1, except that the annealing time in the step S2 was 1 h.

Experiment 1

Properties test of the product obtained in each step, take Embodiment 1 as an example:

In the step S0, the number-average molecular weight (Mn) of the plasticizer was measured by Gel Permeation Chromatograph (GPC), a melting point was measured by Different Thermal Analysis (DSC), a melt index was measured by a melt index test method. Specifically, the sample was put into a melt flow indexer and heated to 210° C., weights with a total weight of 2.16 kg were used, and a mass amount of the melt that flowed out was tested after 10 minutes. Results show that the obtained plasticizer has a number-average molecular weight of 49064, a melting point of 185° C., and a melt index of 20 g/10 min.

In the step S1, the number-average molecular weight (Mn) of the coploymer was measured by GPC, the melting point was measured by DSC, the melt index was measured by melt index test method. Results show that the obtained copolymer has a number-average molecular weight of 199865, a melting point of 185° C., and a melt index of 10 g/10 min.

In the step S3, a gel degree test method and a butyronitrile conversion rate test method were respectively used to test a gel degree and a cyclization degree of PAN fibers after ultraviolet irradiation. The test shows that the gel degree of the PAN fibers irradiated by ultraviolet was 65%, and the cyclization degree was 33%.

Among them, the gel degree test method specifically includes: the irradiated PAN fibers were put into a Soxhlet extractor and refluxed for 24 hours, with dimethyl sulfoxide (DMSO) as solvent; an insoluble matter was filtered and then dried in a high-temperature drying box for 24 hours.

The gel degree (Rg) was calculated according to formula (1), $$Rg = \frac{M_1 - M_2}{M_1} \times 100\%, \tag{1}$$

in formula (1), $M_1$ and $M_2$ are the mass of the fibers and the mass of the insoluble matter, respectively.

The butyronitrile conversion rate test method (cyclization degree) is specifically as follows: a Fourier transform infrared spectrometer (FTIR) was used to characterize the —C≡N and —C═N absorption peaks of the PAN fibers after irradiation.

The butyronitrile conversion rate (Rn) was calculated according to formula (2), $$Rn = \left(1 - \frac{A(C \equiv N)}{A(C \equiv N) + [F \times A(C = N)]}\right) \times 100\%, \tag{2}$$

in formula (2), A(C≡N) and A(C═N) represent the absorbance regions of —C≡N and —C═N, respectively, and F represents the ratio of —C≡N and —C≡N— absorbance constant.

In the step S4, GB3362-3366-82 "Carbon Fibers Test Standard" was used to test the tensile strength of the prepared carbon fibers. It shows that after high temperature pre-oxidation, PAN-based carbon fibers still maintain the fiber morphology, the tensile strength after carbonization is 1.82 GPa, and the tensile modulus is 225 GPa.

The product properties test methods of Embodiments 2-27 are the same as above, as mesophase pitch and glycerol are used as flow modifiers respectively in Embodiments 2 and 3, so there is no need to test the properties of the plasticizer obtained by the step S0. The specific results are shown in Table 2.

Comparative Example 1

A preparation method of PAN-based carbon fibers:

same as Embodiment 1, except that the ABP was not added in the step S0.

The test results show that the gel degree of the PAN fibers irradiated by ultraviolet is 46%, and the cyclization degree is 21%. However, the fiber morphology cannot be maintained after high temperature pre-oxidation. After carbonization, it became powder with no tensile strength and tensile modulus. Because there was no initiator added, the fibers melted in the pre-oxidation stage and became powder after carbonization.

Comparative Example 2

A preparation method of PAN-based carbon fibers:

same as Embodiment 1, except that the mole ratio of AN, MA, and ABP in the step S0 was 92:7:1.

The test results show that because of the decrease of the MA content, the melting performance of the plasticizer is greatly reduced, and the spinning cannot be performed.

Comparative Example 3

A preparation method of PAN-based carbon fibers:

same as Embodiment 1, except that no plasticizer was added (that is, there was no step S0 preparation of a flow modifier), and the conventional flow agent ethylene carbonate (EC) was used.

Due to the secondary melting of the fibers during the pre-oxidation stage, the morphology of the fibers cannot be maintained, and carbon fibers cannot be prepared.

For the convenience of comparison, the process parameters and properties of the carbon fibers prepared in Embodiments 1-27 and Comparative Examples 1 to 3 are listed in Table 1 and Table 2, respectively.

TABLE 1

Process parameters for preparing carbon fibers in Embodiments 1-27 and Comparative Examples 1 to 3

| Embodiments | Composition of plasticizer in step S0 (M1/M2/M3) | Initiator in step S0 | Composition of copolymer in step S1 (M1/M2/M3) | Initiator in step S1 | Flow modifier | Content of flow modifier | Nano-reinforced material |
|---|---|---|---|---|---|---|---|
| 1 | 85/14/1 | 0.1% | 85/15/0 | 0.05% | plasticizer | 20% | — |
| 2 | — | — | 85/14/1 | 0.075% | MP | 1% | GR |
| 3 | — | — | 90/8/2 | 0.1% | glycerol | 50% | GR |
| 4 | 85/14/1 | 1% | 90/7/3 | 0.05% | plasticizer/ glycerolof1/1 | 20% | GR |
| 5 | 80/10/10 | 2% | 90/6/4 | 0.05% | plasticizer/ glycerol/MP of 1/1/1 | 20% | GO |
| 6 | 70/20/10 | 0.1% | 90/5/5 | 0.05% | plasticizer | 20% | GO |
| 7 | 60/20/20 | 0.1% | 90/10/0 | 0.05% | plasticizer | 20% | GO |
| 8 | 60/30/10 | 0.1% | 95/5/0 | 0.05% | plasticizer | 20% | AMWNTs |
| 9 | 60/30/10 | 0.1% | 95/5/0 | 0.05% | plasticizer | 20% | AMWNTs |
| 10 | 60/30/10 | 0.1% | 95/5/0 | 0.05% | plasticizer | 20% | AMWNTs |
| 11 | 89/10/1 | 0.1% | 85/15/0 | 0.05% | plasticizer | 20% | — |
| 12 | 69/30/1 | 0.1% | 85/15/0 | 0.05% | plasticizer | 20% | — |
| 13 | 80/10/10 | 0.1% | 85/15/0 | 0.05% | plasticizer | 20% | — |
| 14 | 60/20/20 | 0.1% | 85/15/0 | 0.05% | plasticizer | 20% | — |
| 15 | 60/30/10 | 0.1% | 85/15/0 | 0.05% | plasticizer | 20% | — |
| 16 | 85/14/1 | 1% | 85/15/0 | 0.05% | plasticizer | 20% | — |
| 17 | 85/14/1 | 2% | 85/15/0 | 0.05% | plasticizer | 20% | — |
| 18 | 85/14/1 | 0.1% | 85/15/0 | 0.05% | plasticizer | 1% | — |
| 19 | 85/14/1 | 0.1% | 85/15/0 | 0.05% | plasticizer | 50% | — |
| 20 | 85/14/1 | 0.1% | 85/15/0 | 0.05% | plasticizer | 20% | — |
| 21 | 85/14/1 | 0.1% | 85/15/0 | 0.05% | plasticizer | 20% | — |
| 22 | 85/14/1 | 0.1% | 85/15/0 | 0.05% | plasticizer | 20% | — |
| 23 | 85/14/1 | 0.1% | 85/15/0 | 0.05% | plasticizer | 20% | — |
| 24 | 85/14/1 | 0.1% | 85/15/0 | 0.05% | plasticizer | 20% | — |
| 25 | 85/14/1 | 0.1% | 85/15/0 | 0.05% | plasticizer | 20% | — |
| 26 | 85/14/1 | 0.1% | 85/15/0 | 0.05% | plasticizer | 20% | — |
| 27 | 85/14/1 | 0.1% | 85/15/0 | 0.05% | plasticizer | 20% | — |
| Comparative Example1 | 85/15/0 | 0.1% | 85/15/0 | 0.05% | plasticizer | 20% | — |
| Comparative Example2 | 92/7/1 | 0.1% | 85/15/0 | 0.05% | plasticizer | 20% | — |
| Comparative Example3 | — | — | 85/15/0 | 0.05% | EC | 20% | — |

TABLE 1-continued

Process parameters for preparing carbon fibers in Embodiments 1-27 and Comparative Examples 1 to 3

| Embodi-ments | Content of nano-reinforced material | Stretching temperature (° C.) | Stretching ratio (times) | Annealing temperature (° C.) | Annealing time (h) |
|---|---|---|---|---|---|
| 1 | — | 170 | 30 | 140 | 6 |
| 2 | 0.1% | 140 | 15 | 120 | 4 |
| 3 | 2.5% | 100 | 4 | 100 | 1 |
| 4 | 5% | 140 | 15 | 120 | 4 |
| 5 | 0.1% | 140 | 15 | 120 | 4 |
| 6 | 2.5% | 140 | 15 | 120 | 4 |
| 7 | 5% | 140 | 15 | 120 | 4 |
| 8 | 0.1% | 140 | 15 | 120 | 4 |
| 9 | 2.5% | 140 | 15 | 120 | 4 |
| 10 | 5% | 140 | 15 | 120 | 4 |
| 11 | — | 170 | 30 | 140 | 6 |
| 12 | — | 170 | 30 | 140 | 6 |
| 13 | — | 170 | 30 | 140 | 6 |
| 14 | — | 170 | 30 | 140 | 6 |
| 15 | — | 170 | 30 | 140 | 6 |
| 16 | — | 170 | 30 | 140 | 6 |
| 17 | — | 170 | 30 | 140 | 6 |
| 18 | — | 170 | 30 | 140 | 6 |
| 19 | — | 170 | 30 | 140 | 6 |
| 20 | — | 140 | 30 | 140 | 6 |
| 21 | — | 100 | 30 | 140 | 6 |
| 22 | — | 170 | 15 | 140 | 6 |
| 23 | — | 170 | 4 | 140 | 6 |
| 24 | — | 170 | 30 | 120 | 6 |
| 25 | — | 170 | 30 | 100 | 6 |
| 26 | — | 170 | 30 | 140 | 4 |
| 27 | — | 170 | 30 | 140 | 1 |
| Comparative Example1 | — | 170 | 30 | 140 | 6 |
| Comparative Example2 | — | 170 | 30 | 140 | 6 |
| Comparative Example3 | — | 170 | 30 | 140 | 6 |

TABLE 2 carbon fibers properties in Embodiments 1-27

| Embodi-ments | Mn of plasticizer in step S0 | Melting point of plasticizer in step S0(° C.) | MI of plasticizer in step S0 (g/10 min) | Mn of copolymer in step S1 | Melting point of copolymer in step S1(° C.) | MI of copolymer in step S1 (g/10 min) | Gel degree | cyclizaion degree | tensile strength (GPa) | tensile modulus (GPa) |
|---|---|---|---|---|---|---|---|---|---|---|
| 1 | 49064 | 185 | 20 | 199865 | 185 | 10 | 65% | 33% | 1.82 | 225 |
| 2 | — | — | — | 149655 | 180 | 15 | 50% | 32% | 2.48 | 272 |
| 3 | — | — | — | 51369 | 170 | 30 | 49% | 31% | 2.98 | 325 |
| 4 | 11657 | 170 | 30 | 195645 | 189 | 7 | 65% | 33% | 2.78 | 301 |
| 5 | 10984 | 150 | 70 | 195641 | 188 | 7 | 70% | 29% | 2.35 | 265 |
| 6 | 49532 | 183 | 25 | 196544 | 187 | 7 | 71% | 39% | 2.87 | 313 |
| 7 | 49051 | 170 | 50 | 196454 | 188 | 7 | 82% | 25% | 2.70 | 292 |
| 8 | 49305 | 170 | 50 | 195641 | — | — | 69% | 33% | 2.52 | 278 |
| 9 | 49534 | 170 | 50 | 193571 | — | — | 69% | 33% | 2.82 | 310 |
| 10 | 49143 | 170 | 50 | 195344 | — | — | 69% | 33% | 3.05 | 331 |
| 11 | 49074 | 188 | 15 | 196515 | 185 | 10 | 65% | 30% | 1.66 | 198 |
| 12 | 49456 | 173 | 33 | 175135 | 185 | 10 | 65% | 37% | 1.85 | 242 |
| 13 | 49302 | 177 | 23 | 188704 | 185 | 10 | 69% | 33% | 1.87 | 230 |
| 14 | 49675 | 170 | 50 | 183568 | 185 | 10 | 82% | 35% | 1.89 | 235 |
| 15 | 49478 | 170 | 50 | 196053 | 185 | 10 | 71% | 37% | 1.77 | 208 |
| 16 | 10694 | 165 | 35 | 193645 | 185 | 10 | 66% | 37% | 1.81 | 220 |
| 17 | 1023 | 150 | 60 | 183415 | 185 | 10 | 65% | 33% | 1.79 | 217 |
| 18 | 48989 | 170 | 30 | 189781 | 185 | 10 | 65% | 33% | 1.99 | 227 |
| 19 | 49603 | 170 | 30 | 197031 | 185 | 10 | 65% | 33% | 1.71 | 203 |
| 20 | 49034 | 170 | 30 | 195645 | 185 | 10 | 65% | 33% | 1.73 | 211 |
| 21 | 49513 | 185 | 20 | 178764 | 185 | 10 | 65% | 33% | 1.68 | 204 |
| 22 | 49351 | 185 | 20 | 195644 | 185 | 10 | 65% | 33% | 1.78 | 212 |
| 23 | 49945 | 185 | 20 | 176889 | 185 | 10 | 65% | 33% | 1.62 | 205 |
| 24 | 49561 | 185 | 20 | 195074 | 185 | 10 | 65% | 33% | 1.75 | 221 |

TABLE 2-continued carbon fibers properties in Embodiments 1-27

| Embodiments | Mn of plasticizer in step S0 | Melting point of plasticizer in step S0(° C.) | MI of plasticizer in step S0 (g/10 min) | Mn of copolymer in step S1 | Melting point of copolymer in step S1(° C.) | MI of copolymer in step S1 (g/10 min) | Gel degree | cyclizaion degree | tensile strength (GPa) | tensile modulus (GPa) |
|---|---|---|---|---|---|---|---|---|---|---|
| 25 | 48651 | 185 | 20 | 189863 | 185 | 10 | 65% | 33% | 1.63 | 207 |
| 26 | 48654 | 185 | 20 | 196546 | 185 | 10 | 65% | 33% | 1.74 | 213 |
| 27 | 49451 | 185 | 20 | 198506 | 185 | 10 | 65% | 33% | 1.61 | 201 |

The above are only certain embodiments of the present disclosure and are not intended to limit the present disclosure. Any modification, equivalent replacement, improvement, etc. made within the spirit and principle of the present disclosure shall be included in the protection scope of the present disclosure.

The invention claimed is:

1. A method of preparing PAN-based carbon fibers, comprising the following steps:

S1, mixing an acrylonitrile, a second monomer and an unsaturated UV-sensitive cross-linking agent, adding an initiator and performing a reaction to obtain a meltable PAN-based copolymer;

S2, mixing a nano-reinforced material with the meltable PAN-based copolymer and a flow modifier to form a mixture, performing an extrusion and pelleting process on the mixture, further performing a melt spinning process to form nascent fibers, then performing a stretching and an annealing process on the nascent fiber to obtain a PAN-based carbon fiber precursor;

the nano-reinforced material is 0-5.0% of a mass of the meltable PAN-based copolymer;

the nano-reinforced material comprises at least one of MXene, carbon nanotubes, graphene, and graphene oxide;

S3, performing an ultraviolet irradiation on the PAN-based carbon fiber precursor;

S4, performing a pre-oxidization process and a carbonization process on the PAN-based carbon fiber precursor after ultraviolet irradiation to obtain PAN-based carbon fibers.

2. The method of preparing PAN-based carbon fibers as claimed in claim 1, wherein, in the step S1, the second monomer comprises at least one of methyl acrylate, methyl methacrylate, itaconic acid, and vinyl imidazole; the unsaturated UV-sensitive cross-linking agent comprises at least one of 4-acryloxybenzophenone, 2-hydroxy-4-acryloxybenzophenone, 2-hydroxy-4-methoxybenzophenone, 4-benzoylphenyl methacrylate, and octadecanophenone; the initiator comprises at least one of ammonium persulfate and azobisisobutyronitrile.

3. The method of preparing PAN-based carbon fibers as claimed in claim 1, wherein, in the step S1, a mole ratio of the acrylonitrile, the second monomer, and the unsaturated UV-sensitive cross-linking agent is 85-95: 5-15:0-5; a mole percentage of the initiator to a polymerized monomer is 0.05-0.1%, the polymerized monomer is a sum of the acrylonitrile, the second monomer and the unsaturated UV-sensitive cross-linking agent.

4. The method of preparing PAN-based carbon fibers as claimed in claim 1, wherein, in the step S2, the flow modifier comprises at least one of low molecular weight PAN copolymer, mesophase pitch, and glycerol.

5. The method of preparing PAN-based carbon fibers as claimed in claim 1, wherein, in the step S2, a mass ratio of the flow modifier to the meltable PAN-based copolymer is 0-1:1.

6. The method of preparing PAN-based carbon fibers as claimed in claim 4, wherein, a number-average molecular weight of the low molecular weight PAN copolymer is 1000-50000;

the low molecular weight PAN copolymer is prepared by the following steps:

mixing the acrylonitrile, the second monomer and the unsaturated UV-sensitive cross-linking agent, adding an excessive amount of the initiator, performing a reaction to obtain the low molecular weight PAN copolymer;

the mole ratio of the acrylonitrile, the second monomer and the unsaturated UV-sensitive cross-linking agent is 60-89:10-30:0-20; the mole percentage of the initiator to the polymerized monomer is 0.1-2%, the polymerized monomer is the sum of the acrylonitrile, the second monomer and the unsaturated UV-sensitive cross-linking agent.

7. The method of preparing PAN-based carbon fibers as claimed in claim 1, wherein, in the step S2, the melt spinning process is conducted at a temperature of 170-230° C.; the stretching process is conducted at a temperature of 100-170° C., a stretching ratio of 4-30 times; the annealing process is conducted at a temperature of 100-140° C., an annealing time of 1-6 hours.

8. The method of preparing PAN-based carbon fibers as claimed in claim 1, wherein, in the step S3, the ultraviolet irradiation is conducted for 1 s-4 h, a light source generated by an ultraviolet irradiation equipment is 5-30 cm away from the PAN-based carbon fiber precursor.

9. The method of preparing PAN-based carbon fibers as claimed in claim 1, wherein, in the step S4, the pre-oxidization process is conducted in a hot air of 180-270° C.; and the carbonization process is conducted in nitrogen with heating to 1000-1200° C.

* * * * *